United States Patent [19]

Acevedo

[11] 4,143,693

[45] Mar. 13, 1979

[54] HAND TOOL WITH POSITIVE-DRIVER BUT FREELY-REVERSIBLE HANDLE

[76] Inventor: Ignacio Acevedo, 4066 Fenwick Ct., Columbus, Ohio 43220

[21] Appl. No.: 862,573

[22] Filed: Dec. 20, 1977

[51] Int. Cl.[2] ..... B25B 15/00

[52] U.S. Cl. ..... 145/76

[58] Field of Search ..... 145/76, 70

[56] References Cited

U.S. PATENT DOCUMENTS

| | | | |
|---|---|---|---|
| 426,827 | 4/1890 | Long | 145/70 |
| 2,950,746 | 8/1960 | Towne | 145/76 |

*Primary Examiner*—James L. Jones, Jr.
*Assistant Examiner*—J. T. Zatarga
*Attorney, Agent, or Firm*—William V. Miller

[57] ABSTRACT

A hand tool, such as a screw driver, with a handle connected to the tool element thereof so that when the handle is turned in one direction, there is a positive driving action but when it is turned in a reverse direction, the handle is free to rotate relative to the tool element. The connection is made by means of a coil spring mounted on a driver shaft member and a driven shaft member, which are connected non-rotatably to the respective handle and tool element. The shaft members are in axial alignment but relatively rotatable, and a coil spring or helix is disposed concentrically around their aligning axes in frictional engagement with both members so that when one member is rotated relative to the other in one direction by the handle, the spring more firmly engages the shaft members to connect them together, to drive the tool element, and when the direction of rotation of the handle is reversed, the axially-aligned shaft members are released by the spring to permit relative free rotation of such members, and, thereby, free reverse movement of the handle relative to the tool element.

5 Claims, 18 Drawing Figures

HAND TOOL WITH POSITIVE-DRIVER BUT FREELY-REVERSIBLE HANDLE

BACKGROUND AND PURPOSE OF THE INVENTION

Screwdrivers and similar hand tools are provided with handles which can be gripped to rotate the tool elements in a driving direction and which are freely rotatable in a reverse direction while the elements are still in engagement with the work. The means for connecting the handle to the tool element for this purpose usually consists of a ratchet mechanism. Ratchet mechanisms are expensive to manufacture, tend to break under substantial torque applied to the handle, and usually require considerable "play" or take-up motion to again apply driving force with the handle after it is turned freely in its reverse movement. One type embodies a large ball-shaped handle difficult to grip.

The present invention provides a simple inexpensive connection between the handle of a tool and the element to be driven which is very rugged and will not tend to break when used to apply considerable driving torque, and which will respond almost immediately without "play" to apply again a driving force to the tool element after reversal of the handle.

BRIEF DESCRIPTION OF THE INVENTION

The above-indicated objects are accomplished by having a special driving connection between the handle and the tool element or socket which receives it. This connection is in the form of two axially aligned relatively rotatable shaft members, which preferably are provided with interfitting means at their adjacent ends for keeping them in axial alignment. One of these shaft members will be non-rotatably connected to the handle and the other to the tool element. A coil spring or helix is disposed with its axis concentric with the axis of these members and frictionally engages both members. Consequently, when the tool element is engaged with the work and one member is rotated slightly relative to the other member, in the proper direction, the members will immediately be more firmly engaged by the spring and will be drivingly connected together so as to drive the tool element. On the other hand, a reverse turning of the handle will result in a reverse rotation of such member, so that there will be some reverse twisting of the spring to permit release of the members for relative rotation and thereby permit the tool element to still engage the work as the handle is reversed.

BRIEF DESCRIPTION OF THE DRAWINGS

The best mode contemplated in carrying out this invention is illustrated in the accompanying drawings in which.

DETAILED DESCRIPTION OF THE INVENTION

One form of the invention is shown in FIGS. 1 to 5 as a simple screwdriver which consists of the handle 20 and the tool element 21 which is indicated as a screwdriver shank but could be any tool, the inner end of which removably slips into a socket in the handle.

Figure 4:
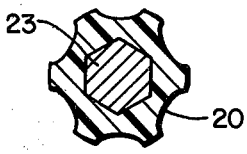
FIG. 4 is a transverse sectional view taken along line 4—4 of FIG. 2.
Figure 4A:
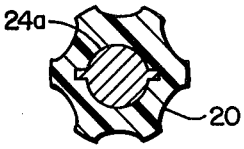
FIG. 4*a* shows a modification of the assembly of FIG. 4.
Figure 5:
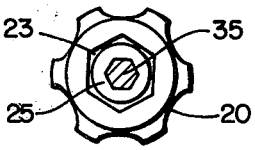
FIG. 5 is a transverse sectional view taken along line 5—5 of FIG. 2.

This invention is embodied in a driver connection 22 which, in this instance, is shown mounted within the handle 20. This connection comprises an inner driving shaft member 23 which is non-rotatably mounted in an outwardly-opening bore 24 in the handle. The member 23 has a hexagonal-shaped inner enlarged end (FIG. 4) which is pressed-fit into the bore 24. However, it could be circular and have anchoring ribs 24*a* as shown in FIG. 4*a*. The connection also includes the driver shaft member 25 which is rotatably mounted in the handle bore 24 and has an enlarged circular outer end, (FIG. 5). Thus, the members 23 and 25 are in axial alignment and have reduced inner cylindrical or tubular portions which received a coil spring 26 that surrounds these portions with a relatively tight frictional fit and is located axially between the shoulders 27 and 28 at the inner ends of the enlargements of the respective shaft members 23 and 25.

This spring 26 is preferably of wire of square or angular cross-section so it will increase its frictional engagement with the annular surfaces of the members 23 and 25. In this instance, it will be wound helically clockwise (FIG. 3) when viewed from the outer or top end of the handle 20. To keep the members 23 and 25 in axial alignment, their inner ends are provided with axial interfitting portions to form a joint 30, and shown as an outwardly-opening socket on the member 23 and a concentric axial inward extension on the member 25.

Also, a screw 31, may be passed loosely axially inwardly through a bore 32 in the member 25 and have its inner end anchored by being tapped into the member 23 to hold these members together axially. However, the screw will not tightly clamp the members together to interfere with relative rotation at the interfitting joint 30. In some cases, the screw can be omitted and friction only can be relied upon to hold the members axially together.

The outer end of the bore 32, in driver member 25, is preferably hexagonal to removably receive the reduced hexagonal stem 35 of the tool element 21. Thus, when member 25 is driven, the tool element will be driven.

Assuming the tool element 21 is engaged with a screw to drive it, the handle 20 is turned in a clockwise direction. This will turn the driver shaft member 23 and, because of the clockwise winding of the spring 26, the spring will twist or wind tighter about the reduced portions of both shaft members 23 and 25 and, in effect, connect them together. This will drive the tool element. A reverse turn of the handle 20 will quickly release the shaft members 23 and 25, permitting free reversal of the handle. This will be due to the fact that the shaft will be unwound slightly and release its frictional grip of the shaft members. If the handle is again turned clockwise, it will immediately exert a driving force on the tool element.

Figure 1:
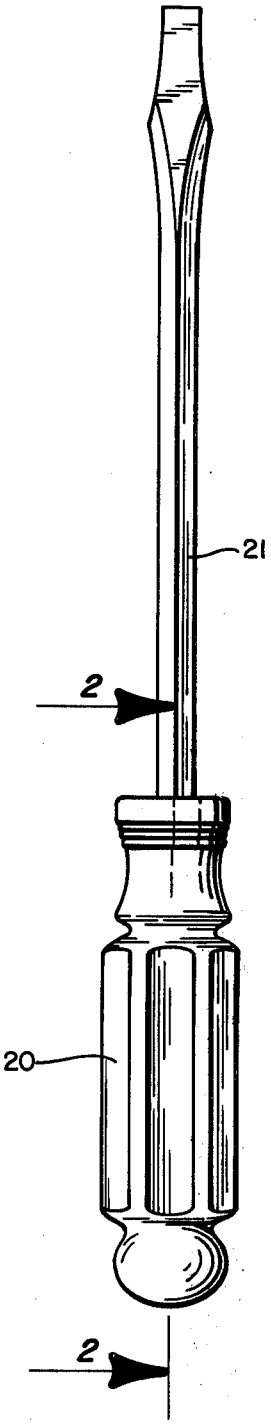
FIG. 1 is a side elevational view of a tool of the screwdriver type embodying this invention.
Figure 2:
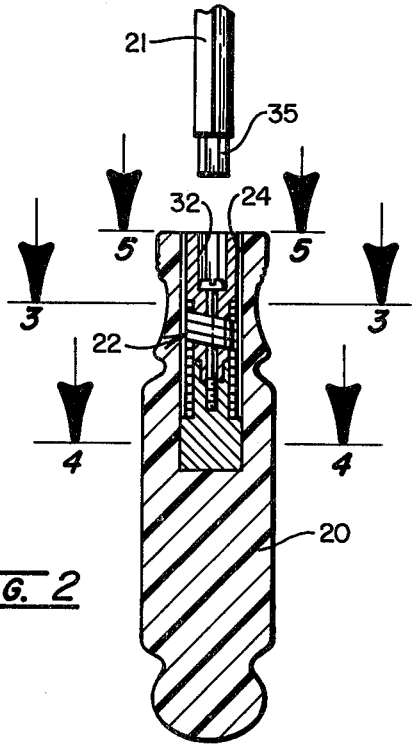
FIG. 2 is an axial sectional view taken along line 2—2 of FIG. 1.
Figure 2A:
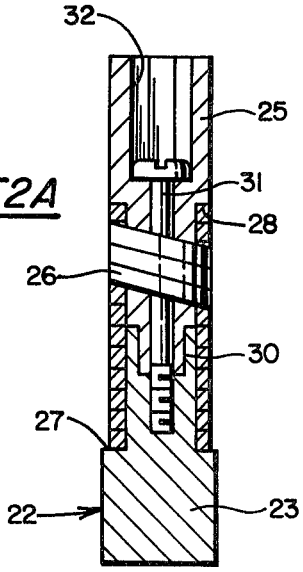
FIG. 2*a* is an enlargement of the connecting unit of FIG. 2 out of the handle.
Figure 3:
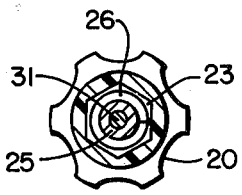
FIG. 3 is a transverse sectional view taken along line 3—3 of FIG. 2.
Figure 6:
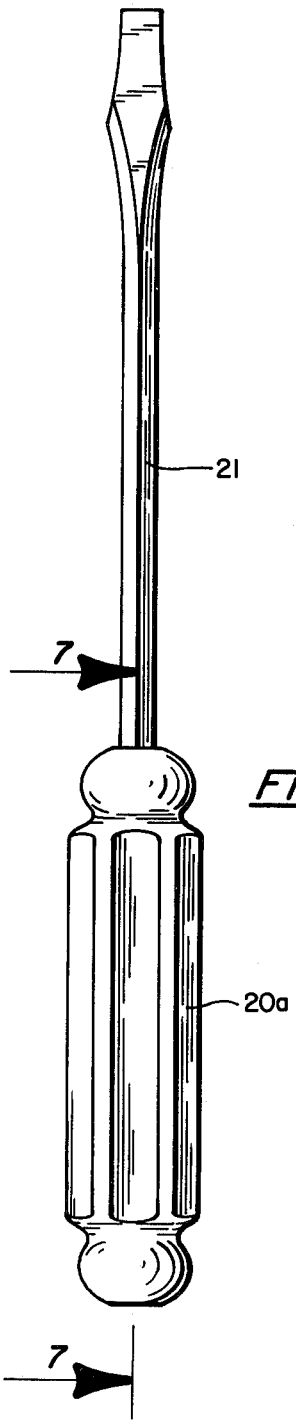
FIG. 6 is a view similar to FIG. 1 but showing a tool having a handle with selective reverse driving arrangements according to this invention, at its opposite ends.
Figure 7:
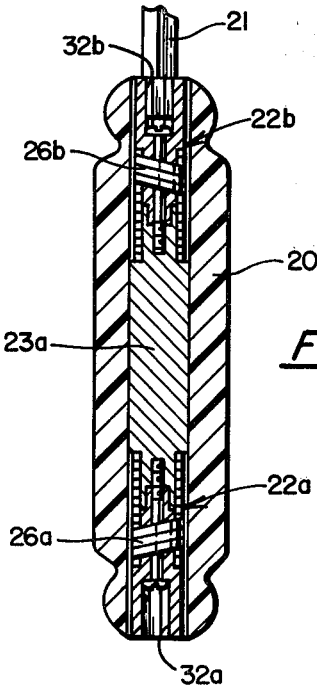
FIG. 7 is an axial sectional view taken along line 7—7 of FIG. 6.

With the connecting arrangement of FIG. 2, the handle 20 would be used for driving the tool element in one direction only. With the handle 20*a* shown in FIGS. 6 and 7, the handle could be used for driving the tool element 21 in either direction selectively. For this reason, the handle 20*a* is equipped with two opposed driver connections 22*a* and 22*b*. These connections will each be practically identical to that previously described but their sockets 32*a* and 32*b* for receiving the tool element 21, will open outwardly at opposite ends of the handle. The fixed shaft member 23*a* will be common to both and will be molded or pressed-fit into the handle. The springs 26*a* and 26*b*, at the opposite ends, will be wound in opposite directions. Thus, it will be apparent that the tool element 21 will be inserted in the socket 32*a*, when it is to be driven in one direction, and in the socket 32*b*, when it is to be driven in the opposite direction.

Figure 8:
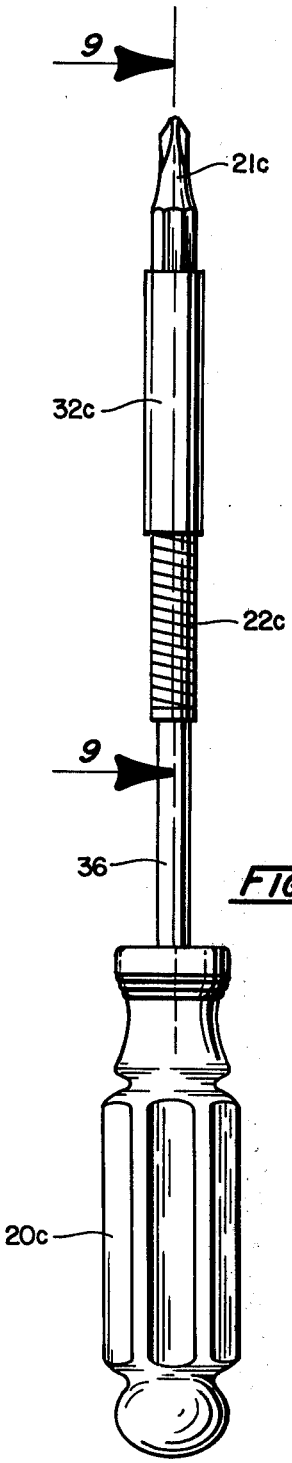
FIG. 8 is a view similar to FIG. 6 but showing a modified freely reversible driver connecting arrangement, according to this invention, disposed outside the handle.
Figure 9:
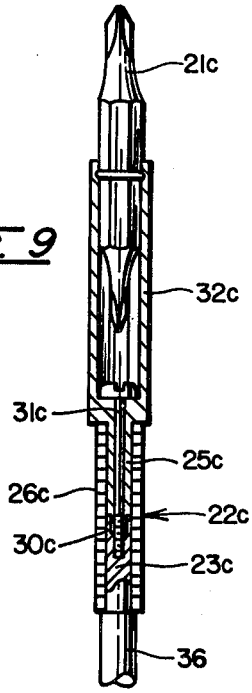
FIG. 9 is an axial sectional view taken along line 9—9 of FIG. 8.

The arrangement shown in FIGS. 8 and 9 is similar to FIGS. 1 to 5 except that the driver connection 22*c* is disposed outside the handle. The handle is shown at 20*c* and has the inner end of a tool driving shank 36 molded or pressed-fit therein. The outer end is reduced to form a driving shaft member 23*c*, of the connection 22*c*, which is similar to the member 23 previously described. The driven shaft member 25*c* is formed as a reduced extension on a tool-receiving socket member 32*c* which is shown removably receiving the tool element 21*c*, which in this case is a Phillips screw driver element. The members 23*c* and 25*c* have the axially interfitting joint 30*c*, preferably along with the retaining screw 31*c*. Around the shaft members 23*c* and 25*c*, is disposed the coil spring 26*c*. This connection 22*c* will function exactly as before and when the handle 20*c* is turned in one direction, it will apply a driving force to the tool element 21*c* and when turned in the opposite direction, it will rotate freely relative to the tool element.

Figure 11:
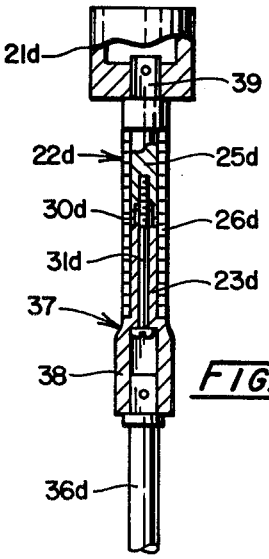
FIG. 11 is an axial sectional view taken along line 11—11 of FIG. 10.
Figure 10:
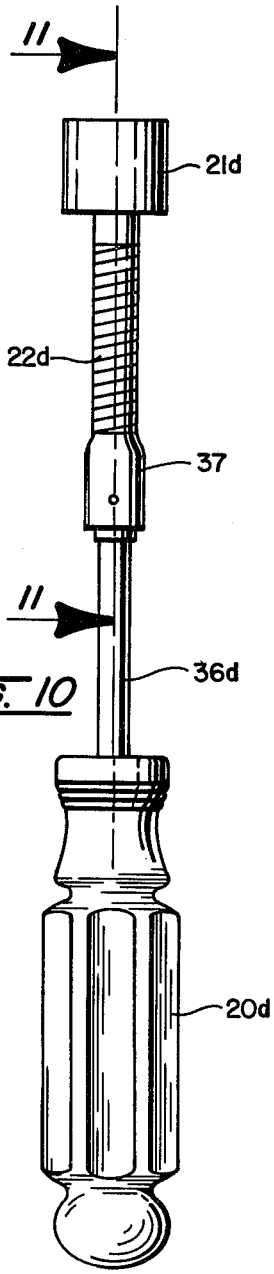
FIG. 10 is a side elevational view showing a connecting arrangement, embodying this invention, incorporated in an adapter disposed between a handle element and a socket element.

The arrangement shown in FIGS. 10 and 11 is similar to that shown in FIGS. 8 and 9 except that the driver connection 22*d* is disposed on an adapter unit indicated generally by the numeral 37. The handle-carried shank 36*d* removably interlocks, in the usual manner, with a hexagonal socket 38 at the inner end of the adapter and the tool element 21*d*, which is shown as a socket wrench, removably interlocks with a hexagonal extension 39 at the outer end of the adapter. The adapter carries the driving and driven shaft members 23*d* and 25*d*, respectively, axially aligned at the interfitting joint 30*d*, and surrounded by the coil spring 26*d*. Screw 31*d* may also be provided. It will be noted that socket member 38 is on driving member 23*d* and extension 39 is on driven member 25*d*.

The unit shown in FIGS. 12 to 16 is a different adapter arrangement for driving the tool element selectively in either direction with a combination driving connection 22*e*, embodying the principles of this invention, and the selective driving can be accomplished without disengaging the unit 22*e* from the tool element.

The unit 22*e* comprises a single driven shaft member 25*e* and a pair of driving shaft members 23*e* and 23*f*, all concentrically disposed. The member 25*e* is of substantially cylindrical cup form and on its outer end has a driving boss or extension 39*e* of square cross section which is designed to fit into the socket of a tool element to drive it in either direction. This member 25*e* has a central circular shaft portion 25*f* surrounded by an annular groove 40 which opens downwardly or outwardly. Similarly, the driving member 23*e* is mainly of cylindrical cup form and is centrally recessed to provide an upwardly or outwardly opening annular groove 41. The member 23*e* has a hexagonal formation 38*e* on its exterior. The driving shaft member fits concentrically within the member 23*e* in axial alignment with shaft portion 25*f* of the driven shaft member 25*e*. The adjacent inner ends of the shaft portions 23*f* and 25*f* have an axially interlocking joint 30*e* which permits relative rotation of these members but keeps them axially aligned. Screw 31*e* may, also be provided for this purpose and is passed through a bore in portion 23*f* and is tapped into portion 25*f*, the bore having an outer hexagonal socket end 32*e*. Flange 42 on the outer end of member 23*f* contacts member 23*e* to limit axial inward movement of member 23*f* to prevent binding at the joint 30*e*.

The annular groove 41 opens towards and communicates with the annular groove 40. Together they form a closed spring-receiving chamber in which a pair of concentric coil springs 26*e* and 26*f* are disposed in spaced relationship. These springs are helically wound in the same direction. The outer or larger spring 26*e* is in firm frictional engagement with the outer skirts of the respective members 23*e* and 25*e* which, in effect, are hollow shaft members. The inner or small spring 26*f* firmly surrounds the relatively solid shaft members 23*f* and 25*f*.

It will be apparent that if member 23*f* is rotated, in the proper direction, this will tighten or contract the inner spring 26*f* on the cylindrical or annular surface of both members 23*f* and 25*f*, thereby driving the entire member 25*e*, which, in turn, will drive the tool element through the driving extension 39*e*. Since the outer spring 26*e* will be wound in the same direction, it will not be moved outwardly into firmer engagement with the skirts of the members 23*e* and 25*e* by the driving of member 23*f*. As soon as rotation of member 23*f* is reversed, the spring 26*f* will release the members 23*f* and 25*f* and reverse rotation of member 25*e* will not occur since member 23*f* will freely rotate therein and there will be no effect on spring 26*f* or spring 26*e*.

On the other hand, if member 23*e* is rotated on member 23*f* in a direction opposite to that which the member 23*f* originally was rotated, this will expand the outer spring 26*e* into tighter engagement with the outer skirts of the members 23*e* and 25*e*, thereby driving the member 25*e* to drive the tool in a reverse direction but this will have no effect on the inner spring 26*f* since rotation of member 25*f* will tend to unwind this spring. Reverse turning of member 23*e* will loosen outer spring 26*e* and have no effect on inner spring 26*f* since member 23*f* will freely rotate therein. Thus, a free reversal movement without disturbing the tool element is permitted.

Figure 12:
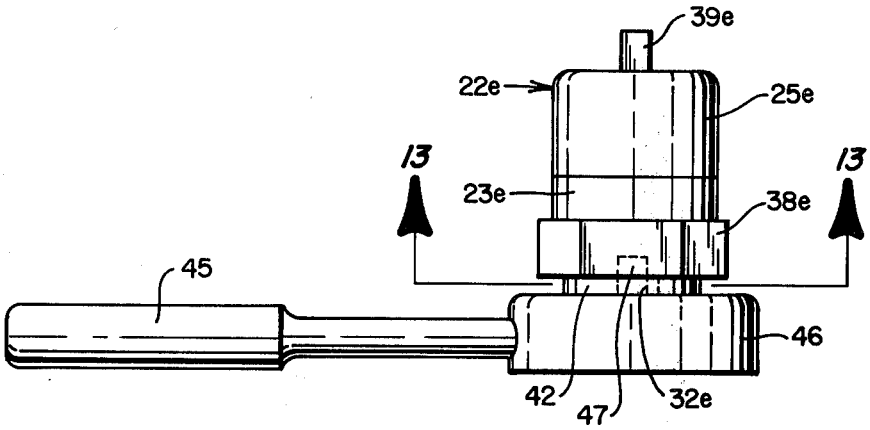
FIG. 12 is a side elevational view of a tool embodying the connection of this invention for selective use in either direction of rotation, one selected use being illustrated.
Figure 13:
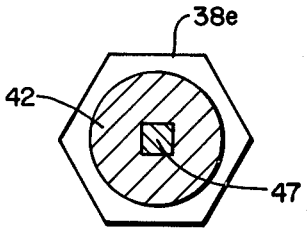
FIG. 13 is a transverse sectional view taken along line 13—13 of FIG. 12.
Figure 14:
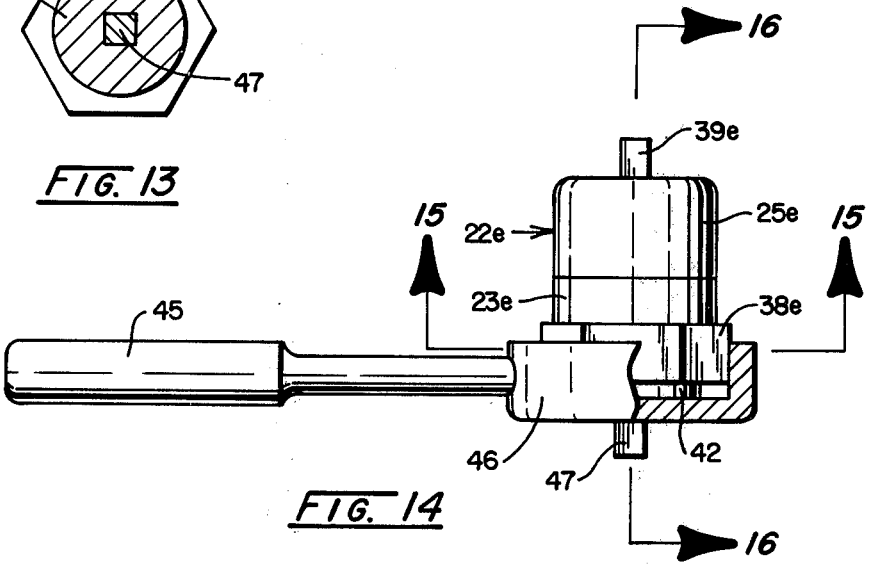
FIG. 14 is a view, partly in side elevation and partly in section, similar to FIG. 12 but indicating the other use.
Figure 15:
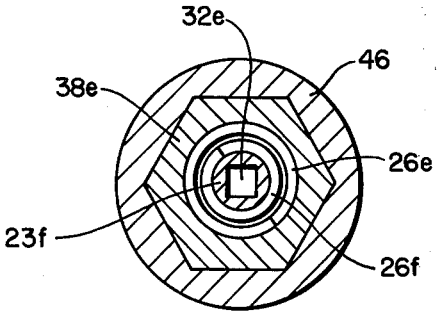
FIG. 15 is transverse sectional view taken along line 15—15 of FIG. 14.
Figure 16:
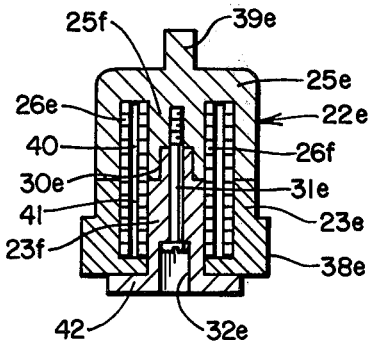
FIG. 16 is an axial sectional view taken along line 16—16 of FIG. 14.

The means for obtaining the selective rotation of members 23*e* and 23*f* is the lever type handle 45. It is provided with a head 46 and on a flat face of the head is a square lug 47 which can be inserted in the socket 32*e*, as shown in FIG. 12, to rotate the member 23*f*. The other side of the head 46 has a hexagonal socket 48 formed therein which can be slipped over hexagonal formation 38*e*, as shown in FIG. 14, to rotate the member 23*e*.

It will be understood that with this particular form of the invention, there are two selective positive-driver but freely-reversible connections. One is provided by the inner spring around the two relatively rotatable shaft members, which constricts therearound when rotated in a driving direction, and the other is provided by the outer spring within the hollow relatively rotatable shaft members, which expands thereagainst when rotated in a driving direction.

SUMMARY

This invention provides a hand tool which has a torque-applying handle connected to the tool element by a simple and inexpensive yet very effective connection which permits positive drive by the handle in one direction and free reversal of the handle in the opposite direction. In all forms, the handle is easily grasped. The connection in all forms consists of relatively rotatable shaft members, axially aligned and interfitting to maintain alignment. In each case, a helical spring extends along both members concentric with the axis thereof and is so arranged that when the handle is turned in the driving direction, torque is applied to the spring to cause it to either expand or contract into engagement with the surfaces of such members. The engagement is between the angular material of the spring and the annular surfaces of the members to be connected so there will be firm frictional engagement. Turning, of the handle in the opposite direction releases the spring and permits free reverse rotation of such handle. Again rotating the handle in the driving direction causes it to immediately apply driving torque to the tool element.

Having thus described this invention what is claimed is:

1. A hand tool having a handle for selectively applying torque driving force to a tool element or freely reverse turning relative to the tool element comprising a driving connection between the handle and the tool element, said connection comprising axially-aligned relatively rotatable shaft members non-rotatably connected respectively to the handle and the tool element and having annular contact surfaces, and a coil spring extending axially of the shaft members and disposed helically about the axes thereof in frictional engagement with said contact surfaces so that when the handle is rotated in one direction, the driving shaft member connected thereto, twists the spring in the proper direction to apply driving torque to the driven shaft member connected to the tool element but when the handle is rotated in a reverse direction the spring is twisted to release the driving torque to permit free rotation of the handle relative to the tool element, said shaft members comprising a first shaft member having means for connecting it non-rotatably to the handle and a second shaft member having means for connecting it non-rotatably to a tool element, said shaft members having axially-aligned inter-fitting inner central shaft portions, said coil spring helically wound around such portions, said second shaft member having an outer skirt concentric with the inner shaft portion thereof, a third shaft member rotatable relative to the first and second shaft members having an outer skirt axially aligned with the skirt of the second shaft member and concentric with the inner shaft portion of the first shaft member, a second coil spring disposed helically within the aligned skirts and frictionally engaging therewith but spaced from the first spring, said springs being wound in the same direction, and said handle including means for selectively rotating either said first shaft member or said third shaft member.

2. A hand tool according to claim 1 in which a retaining screw is passed axially loosely through the first shaft member into the second shaft member where it is anchored.

3. A hand tool having a handle for selectively applying torque driving force to a tool element or freely reverse turning relative to the tool element comprising a driving connection between the handle and the tool element, said connection comprising axially-aligned relatively rotatable shaft members non-rotatably connected respectively to the handle and the tool element and having annular contact surfaces, and a coil spring extending axially of the shaft members and disposed helically about the axes thereof in frictional engagement with said contact surfaces so that when the handle is rotated in one direction, the driving shaft member connected thereto, twists the spring in the proper direction to apply driving torque to the driven shaft member connected to the tool element but when the handle is rotated in a reverse direction the spring is twisted to release the driving torque to permit free rotation of the handle relative to the tool element, said shaft members comprising a first shaft member having means for connecting it non-rotatably to the handle and a second shaft member having means for connecting it non-rotatably to a tool element, said shaft members having axially-aligned inner central shaft portions, said coil spring helically wound around such portions, said second shaft member having an outer skirt concentric with the inner shaft portion thereof, a third shaft member rotatable relative to the first and second shaft members having an outer skirt axially aligned with the skirt of the second shaft member and concentric with the inner shaft portion of the first shaft member, a second coil spring disposed helically within the aligned skirts and frictionally engaging therewith but spaced from the first spring, said springs being wound in the same direction, and means for selectively rotating either said first shaft member or said third shaft member.

4. A hand tool according to claim 3 in which said handle has an angular driving socket for receiving a complemental angular formation on the exterior of said third shaft member and an angular driving lug for fitting into a complemental angular socket in said first shaft member.

5. A hand tool according to claim 3 in which each of the springs is made of material of angular cross-section and is helically wound to engage the respective cooperating axially aligned shaft members.

* * * * *